US006050463A

United States Patent [19]

De Bono et al.

[11] Patent Number: 6,050,463

[45] Date of Patent: Apr. 18, 2000

[54] COMPOSITE LEATHER BANDS AND METHODS OF MANUFACTURE

[75] Inventors: Joseph A. De Bono, Danedin; Francisco Monge-Arias, Kenneth City, both of Fla.

[73] Assignee: Norman M. Morris Corporation, White Plains, N.Y.

[21] Appl. No.: 08/957,873

[22] Filed: Oct. 20, 1997

[51] Int. Cl.[7] ..... A44C 5/00; A44C 5/10; A41F 9/00; A41F 3/02

[52] U.S. Cl. ..... 224/178; 224/164; 2/338; 156/196

[58] Field of Search ..... 224/164, 178, 224/177; 2/338, 321, 322; 368/281, 282; 63/3, 3.1, 3.2, 4, 9, 10; 59/84, 90; 156/196, 137

[56] References Cited

U.S. PATENT DOCUMENTS

| | | | |
|---|---|---|---|
| 1,424,110 | 7/1922 | Maakestad | 2/338 |
| 1,847,182 | 3/1932 | Heyer | 2/338 |
| 3,154,960 | 11/1964 | Creswell | 2/338 |
| 4,639,948 | 2/1987 | Adell | 2/338 |

FOREIGN PATENT DOCUMENTS

| | | | |
|---|---|---|---|
| 2533120 | 3/1984 | France | 224/164 |
| 2630678 | 11/1989 | France | 224/178 |

*Primary Examiner*—Linda J. Sholl
*Attorney, Agent, or Firm*—Abelman, Frayne & Schwab

[57] ABSTRACT

An elongated band, suitable for use as a watch strap, belt, head band or luggage strap, is fabricated from a plurality of individual overlapping, and optionally interlocking, segments of leather, or leather-like material that are bonded together to form an upper or outer layer, which is in turn bonded to a conventional backing material, such as a band substrate. The assembled and finished band can be tooled to provide distinctive surface configurations of striking ornamental appearance; alternative configurations of the overlapping segments resemble metal expansion bands for wrist watches.

10 Claims, 5 Drawing Sheets

COMPOSITE LEATHER BANDS AND METHODS OF MANUFACTURE

FIELD OF INVENTION

The invention relates to watch straps, wrist bands, belts, shoulder straps and hand bag straps, head bands, necklaces, luggage straps and the like constructed from a plurality of individual overlapping pieces.

BACKGROUND OF THE INVENTION

It has been known to produce straps or bands for wrist watches from two or more pieces of leather, or leather substitutes, that form the outer and inner layers and are adhesively joined to provide an integral laminated composite construction.

It is also known to emboss or tool the outer or exterior surfaces of leather watch straps, wrist bands and belts to produce a decorative effect, including the appearance of multiple pieces of leather joined along seams, or the like. However, the effects that can be created by embossing are limited, and if not carefully done, the prospective purchaser is likely to lose interest in the watch band or belt upon closer inspection.

It is therefore an object of the invention to provide watch straps, wrist bands and belts constructed from a plurality of individual pieces of leather or skin assembled in overlapping relation that present an aesthetically attractive and eye-appealing appearance.

It is another object of the invention to provide methods for constructing watch straps and belts from natural leather and the like where the outer exposed surface is assembled from a plurality of overlapping smaller pieces that can be die-cut from relatively small and irregularly shaped pieces of finished leather that might otherwise be discarded as scrap.

It is yet a further object of the invention to provide a strap or belt construction of relatively small elements that are tooled and of delicate appearance, which construction is also durable.

Another object of the invention is to provide a construction, the static appearance of which is that of a metal bracelet or band that is assembled from a plurality of small overlapping components.

SUMMARY OF THE INVENTION

The invention provides watch strap sets of strikingly attractive and novel ornamental appearance and a method for their construction. The novel construction employs a plurality of individual overlapping and optionally interlocking segments that are bonded together to form the upper or outer layer of the strap. The upper layer is adhesively joined to a conventional backing material, such as a band substrate. When assembled, the individual segments produce an aesthetically-pleasing and coordinated repeating pattern on the tip and buckle portions of the watch strap set. The finished strap is both attractive and durable.

In a first preferred embodiment, the overlapping segments are provided with at least a first, and preferably a second transverse opening through which first opening a narrowed neck portion of an adjacent segment is passed, and through which second opening a neck portion of a sub-adjacent segment is passed. In one preferred construction, each of the three segments lie in a generally parallel, three-layered superposed longitudinal array.

In another preferred construction of the first embodiment, the neck portion of the adjacent segment is passed through the transverse opening and then folded back into a U-shaped configuration, thereby also providing a three-layered construction, but from only two segments. Following their assembly, adhesive is applied to bond the plurality of overlapping segments to each other and also to a watch band substrate or backing of conventional construction.

The tip and buckle sections are then tooled, preferably by placing them in respective tooling dies to finally form and shape the upper surfaces of these section. The sections are then provided with a buckle and hole-punched to receive the buckle tongue. The strap sections are then cut to their desired shape and the cut edges are polished. Final finishing can include creasing, painting, stitching, trimming and sewing of the tip retaining loops, all in accordance with methods well-known in the art.

In a second preferred embodiment, the intermediate overlapping segments comprising the upper or exposed surface of the straps are of a stepped, or flattened "Z" configuration. The upper finished portion of each stepped segment overlaps in superposed relation the lower portion of an adjacent segment. The upper surface of the intermediate overlapping segments, the lug ends, and to some extent the buckle and tip ends are of uniform size and appearance. The transverse parting lines in one preferred construction of this embodiment are uniformly spaced longitudinally and are reminiscent in general appearance of a metal expansion band having uniform rectangular upper segments. When the overlapping planar surfaces are adhesively bonded and in spaced-apart relation to complete the unitary construction, the individual upper finished surfaces are able to flex and move independently of each other, thereby providing a unique and aesthetically pleasing effect.

In other preferred constructions of this second embodiment, the sizes of the finished upper surfaces and/or the longitudinal spacing between the finished surfaces is not uniform, and need not extend to the lug and/or point and buckle ends of the respective strap sections. These variations provide further pleasing aesthetic effects that have not heretofore been known to the art.

Following adhesive bonding of the overlapping upper segments, including lug ends, and point and buckle ends, these assemblies are adhesively bonded to a conventional band substrate as was described above in connection with the first preferred embodiment.

BRIEF DESCRIPTION OF THE DRAWINGS

The above objects and advantages, and others, will become apparent from the description which follows when read in conjunction with the drawings in which.

DESCRIPTION OF THE PREFERRED EMBODIMENTS

Figure 1B:
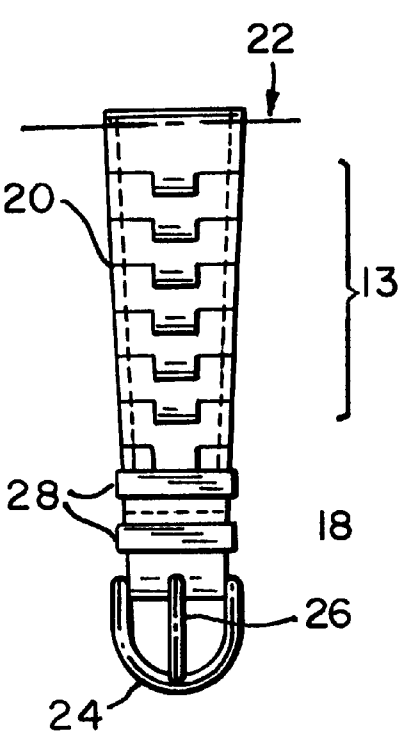
FIG. 1B is a top plan view of the buckle portion of a watch strap set for mating with the point portion of FIG. 1A.
Figure 1C:
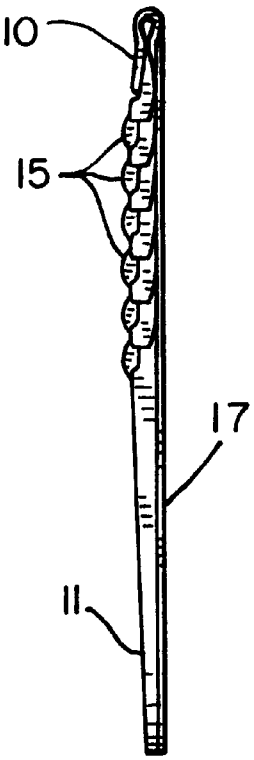
FIG. 1C is a side view of the strap of FIG. 1A.
Figure 1A:
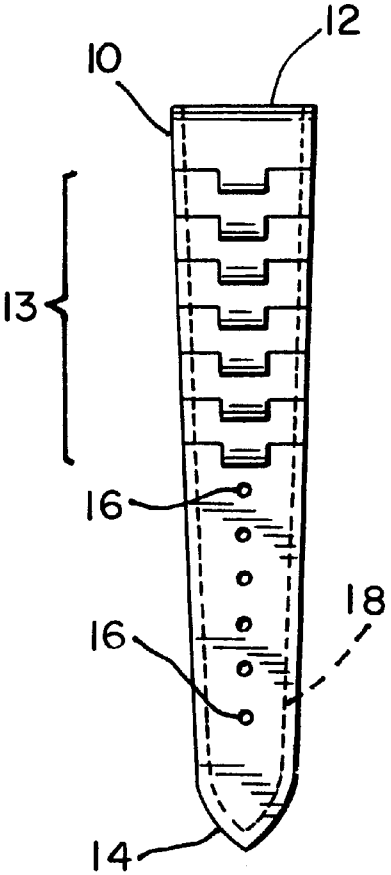
FIG. 1A is a top plan view of the point portion of one preferred embodiment of a watch strap set of the invention.

With reference to FIGS. 1A–1C, there is shown a pair of watch straps, the novel upper or exposed surface construction and ornamental appearance of which is produced in accordance with the method of the invention. FIG. 1A illustrates a first preferred embodiment of the point portion 10 of a watch strap having lug end 12 for receiving a conventional mounting pin [not shown] for joining the strap sections to the watch case. A plurality of intermediate overlapping segments 13 to be described in detail below lie between lug end 12 and point end 14.

With reference to FIG. 1B, a similar construction is illustrated for the buckle portion of the strap, where a plurality of intermediate overlapping segments 13 lie between lug end 22 and buckle end 24. As shown in the side view of the point portion 10 of FIG. 1C, the upper or exposed surface 11 is bonded to a conventional band substrate 17 which can be of leather or artificial material. As best shown in the side view of FIG. 1C, a portion of the intermediate overlapping segments 13 project above the surface, and in a preferred embodiment to be described below, are tooled to provide a stepped or sawtooth appearance.

It will be understood that overlapping segments 13 of buckle portion 20 are also tooled to provide the same appearance as point portion 10.

Point portion 10 is provided with a plurality of centrally aligned holes 16 for receiving the tongue 26 of the buckle assembly. Strap sections 10 and 20 can optionally be provided with decorative stitching 18. suckle portion 20 is also fitted with one or more restraining bands 28 to receive tip 14.

The construction of the strap illustrated in FIGS. 1A–C will be described with reference to the elements illustrated in the series of FIGS. 2A–D. As will be understood by one familiar with the manufacture of watch straps, wrist and head bands, belts and the like, the leather, animal skins or other materials of construction are prepared in the ordinary way for die-cutting into the several configurations that are required to complete the assemblies of the point 10 and buckle 20 portions of the straps. To produce the strap set of FIGS. 1A–C, the four different die-cut shapes shown in FIGS. 2A–2D are preferably employed. The shaded areas in the die-cut pieces represent surfaces that have been roughened to improve the penetration of adhesive, or skived to provide a tapered cross-section.

Figure 2B:
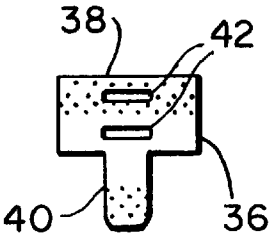
FIG. 2B is a top plan view of an overlapping interlocking segment employed in the strap set of FIGS. 1A and 1B.
Figure 2D:
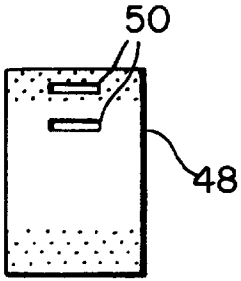
FIG. 2D is a top plan view of a buckle end segment employed in the strap of FIG. 1B.
Figure 2A:
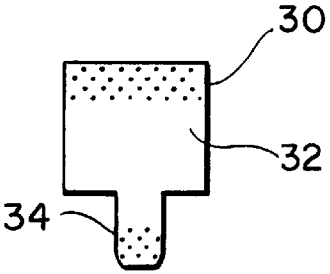
FIG. 2A is a top plan view of the lug end segment employed in the strap set of FIGS. 1A and 1*b;*

FIG. 2A illustrates the lug end segment 30, two of which are required, each comprised of body 32 which extends across the width of the strap and a narrower neck portion 34 depending from the body and forming a "T".

FIG. 2B illustrates the configuration of the overlapping, and in this embodiment, interlocking segments, twelve of which are used in the construction illustrated, each overlapping segment comprising body 38 which extends across the width of the strap and integral depending neck portion 40 extending in the longitudinal direction. Each interlocking segment 36 is provided with at least one die-cut opening 42 which is adapted to receive the neck 40 of an adjacent interlocking segment, or neck 34 of a lug segment. Assembly of interlocking segments having a single die-cut opening 42 is described below with reference to FIG. 4B. For the purposes of the preferred embodiment illustrated, interlocking segment 36 is provided with two die-cut transverse openings 42, the assembly of which will be described in more detail with reference to FIG. 4A.

Figure 2C:
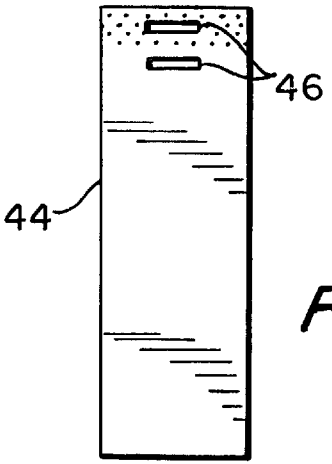
FIG. 2C is a top plan view of a tip end segment employed in the strap of FIG. 1A.

With reference to FIG. 2C there is shown the die-cut element 44 from which the tip end 14 is formed, one of which is required, and which is provided with a pair of die-cut transverse openings 46 that are adapted to receive the neck portion 40 of segments 36.

FIG. 2D illustrates the configuration of the die-cut piece from which the buckle end 24 is formed, one of which is required. Buckle end piece 48 is also provided with a pair of die-cut transverse openings sized and positioned as in FIG. 2C.

In order to facilitate the assembly of the strap, the top edges of the lug ends (as shown by the shaded area) are roughened to remove the finish to permit proper penetration of adhesive; the lower edge of neck portion 34 is skived to provide a taper running from the upper surface to the back surface of neck portion 34. The neck portion 40 of each interlocking segment 36 is similarly skived to provide a taper. The buckle piece 48 is also roughened along its upper edge as shown by the shaded areas and skived from the back to provide a taper.

Figure 3:
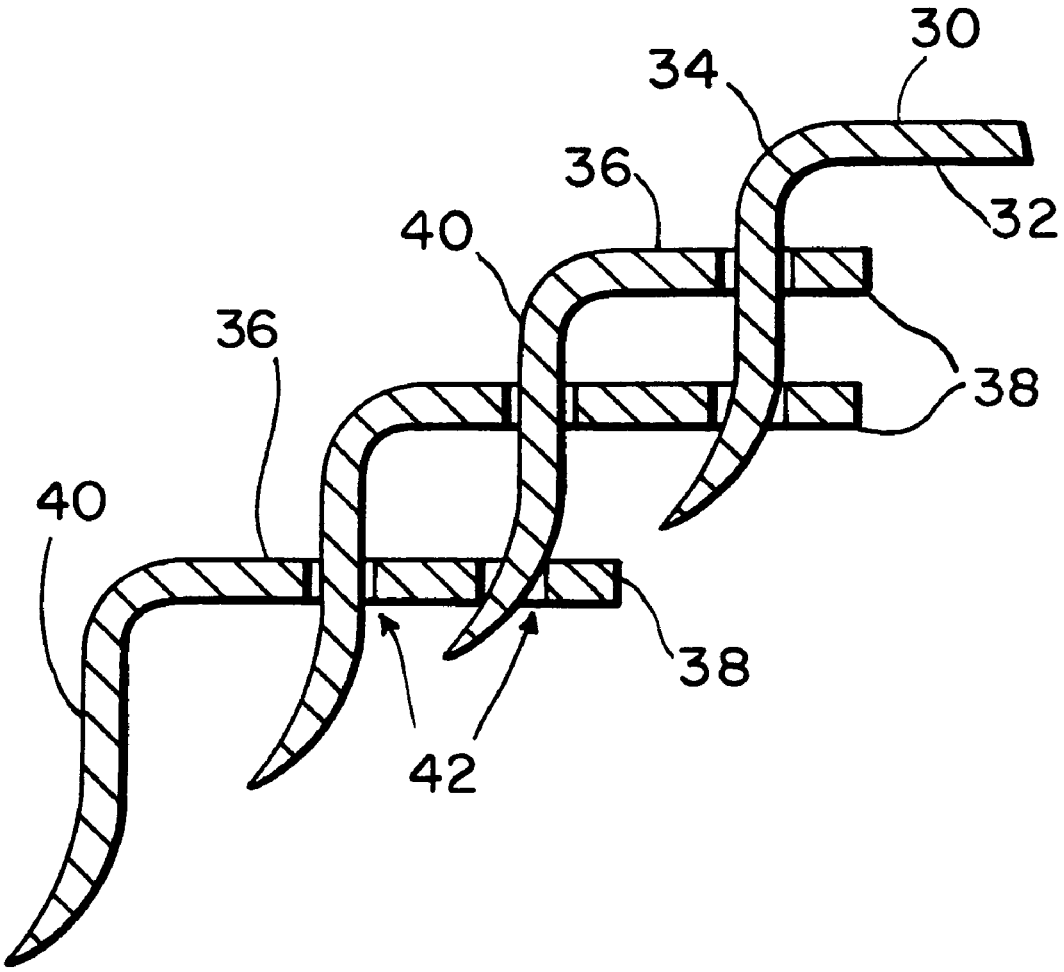
FIG. 3 is a side view of several partially assembled overlapping interlocking segments of the embodiment of FIGS. 1A–C.

With reference to FIG. 3, there is shown in side view a partially assembled strap in accordance with the first preferred embodiment. A plurality of interlocking segments 36, each having a pair of transverse die-cut openings 42 are joined by inserting the neck portions 40 of an adjacent and sub-adjacent segment, while the segments are in superposed relation. The tips of the neck portion are bonded, as by adhesive, to the underside of an adjacent and/or sub-adjacent segment extending in the same longitudinal direction. The assembly of FIG. 3 terminates at the right side in lug end piece 30, the neck portion of which has been passed through an adjacent and sub-adjacent interlocking segment. At the left side of the assembly of FIG. 3, the neck portion of an adjacent and sub-adjacent segment is passed through the die-cut openings in tip end piece 44 and adhesively bonded to complete the assembly of the tip portion of the strap. The same stepwise method is employed in assembling the lug end, intermediate interlocking segments and buckle piece 48 for the buckle portion 20 of the strap set.

Figure 4B:
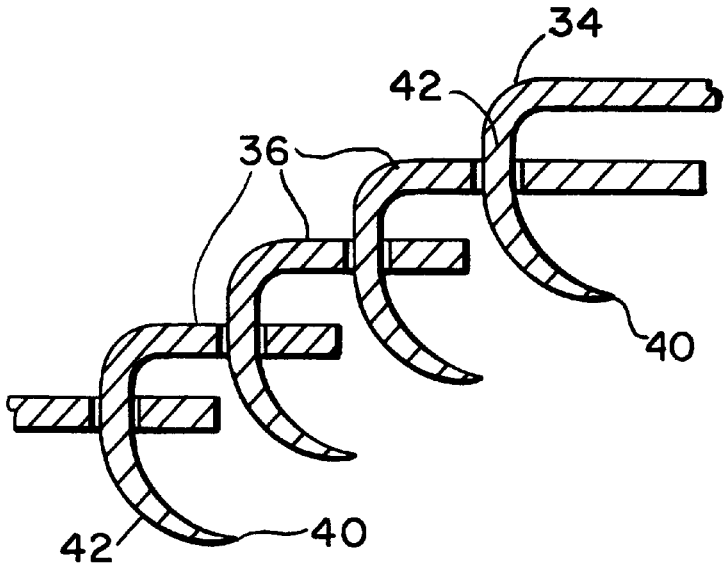
FIG. 4B is a side view of several partially assembled interlocking segments in a modification of the embodiment of the invention of FIG. 4A.
Figure 4A:
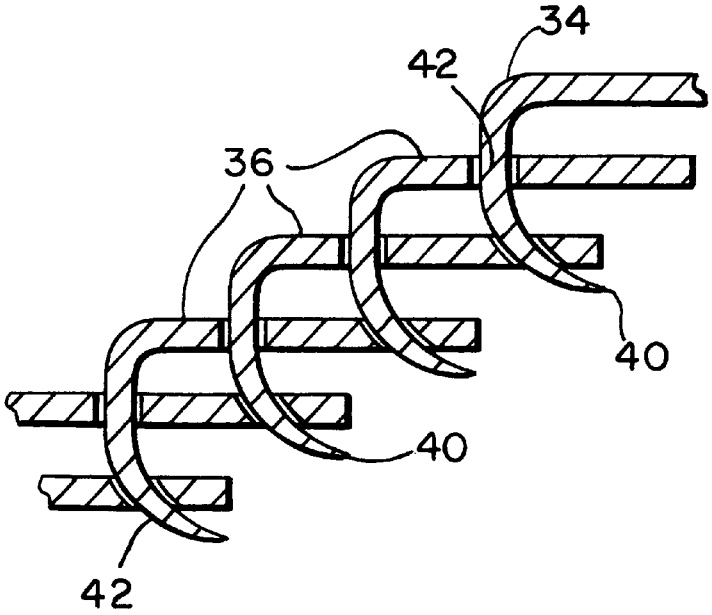
FIG. 4A is a side view of several partially assembled interlocking segments in accordance with another embodiment of the invention.

An alternative construction of the first preferred embodiment is illustrated in FIG. 4A. The neck portion 40 of the segments 36 are passed through openings in an adjacent and sub-adjacent pair of segments and are then folded under and back upon themselves into a U-shaped configuration, where they are bonded, as by adhesive. The straps are then finished in accordance with the procedures described above.

In another modification of this embodiment which is illustrated schematically in FIG. 4B, neck portion 34 of lug end piece 30 is passed through a die-cut transverse opening 42 in a single adjacent interlocking segment 36. In the construction of this embodiment, each lug end, interlocking segment, tip end piece and buckle end piece are provided with one transverse diecut opening, and each neck portion passes through only one adjacent piece.

As will be apparent to one of ordinary skill in the art, the elements of construction and method of assembly can be varied without departing from the teachings of the invention. For example, employing segments with a single die-cut transverse opening, the neck portion of an adjacent segment can be passed through and bonded in the same longitudinal direction, rather than being reversed in the U-shaped configuration described above.

Following the bonding together of the several pieces forming each portion of the strap, the upper or exposed assembly is bonded to the band substrate 17. The upper surface of the interlocking segments are now tooled to provide the finished sawtooth or stepped configuration best shown in FIG. 1C. The tooling can be accomplished using hand implements for each individual interlocking segment or a special dye can be fashioned for tooling the group of segments 13 on the respective strap portions.

By employing this method of construction, assembly and finishing, it can be seen that a watch strap is provided having a novel and aesthetically pleasing appearance.

Figure 5B:
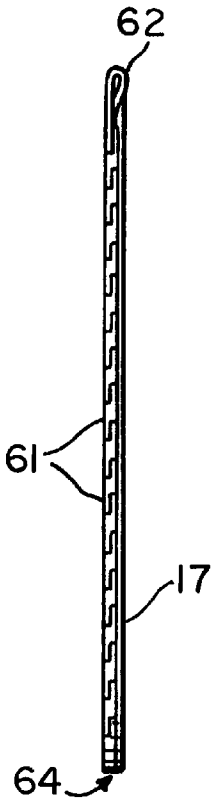
FIG. 5B is a side view of the strap of FIG. 5A.
Figure 5A:
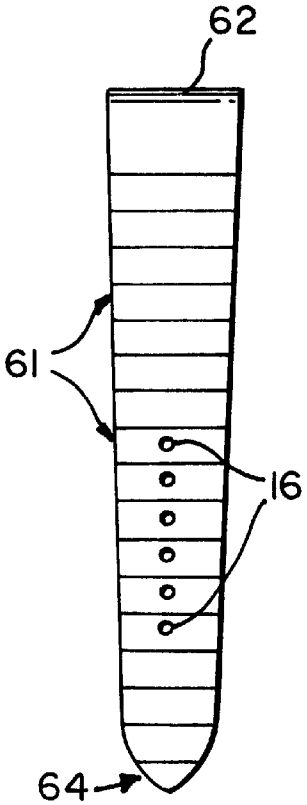
FIG. 5A is a top plan view of the point portion of another preferred embodiment of a watch strap of the invention.

With reference to FIGS. 5A–C, there is shown a second preferred embodiment of a watch strap of the invention having an outer exposed surface comprising a plurality of longitudinally adjoining individual segments, where each segment has a first finished upper portion and a contiguous second portion that is overlapped by an adjacent segment. In this embodiment, the appearance of the finished strap is reminiscent a conventional segmented metal expansion band. Shown in FIG. 5A is the point portion 60 comprising lug end piece 62, intermediate interlocking segments 61 and tip end piece 64. The configuration and method of assembly of overlapping segments 61 will best be understood by reference to the schematic cross-sectional view of FIG. 6 in which alternating segments are shaded for purposes of illustration only.

Figure 6:
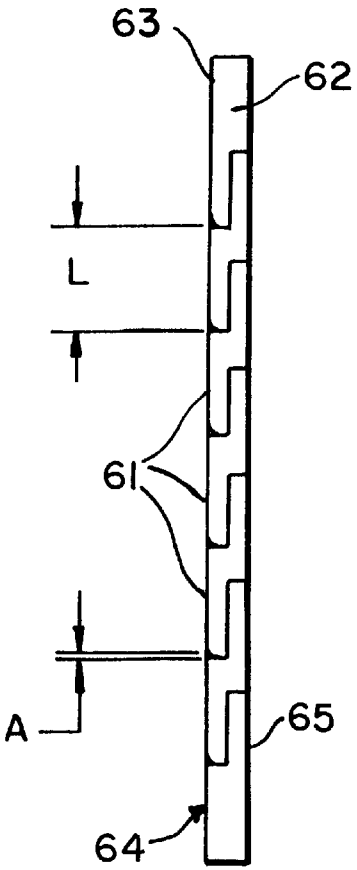
FIG. 6 is a schematic side sectional view of a portion of the upper layer of the embodiment of FIGS. 5A and 5B illustrating the construction.

In this embodiment, all of the overlapping segment 61 are of the same size and of stepped or flattened Z configuration. Also as best shown in FIG. 6, lug end 62 terminates at one end in a thinned neck portion 63 which overlaps adjacent segment 61. Similarly, end piece 64 comprises thinned neck portion 65 which is overlapped by the upper leg of adjacent segment 61. The buckle portion of the strap (not shown) is assembled in a similar fashion employing a lug end piece 62 and a buckle end piece.

In a preferred construction of this second embodiment, the upper portions of segment 61 are spaced apart at a distance "A" along the longitudinal axis of the strap as shown in FIG. 6. This spacing provides for additional flexibility, and creates a distinctive appearance that is aesthetically appealing. In further alternative embodiments contemplated by the invention, the spacing between the upper surfaces of the segments 61 can be varied, and the longitudinal length "L" of the upper portion of the segments can be varied to create different aesthetically appealing effects, other shapes, such as curvilinear and irregular rectilinear can be employed for the respective segments. Materials, color and finish can also be varied among the segments to create distinctive effects.

As shown in the side view of FIG. B, the upper assembly is bonded to a band substrate 17, after which it can be trimmed and finished in accordance with standard techniques and methods.

The size and thickness of the segments and the portions of the segments can be vaired. In a perferred embodiment the maximum thickness of a segment is about one millimeter. The longitudinal length "L" of the first and second positionsof the segment can be the same or the second position can be relatively longer than the first portion. The strap construction can also include a layer of resilient padding material that is bonded between the overlapping segments and the strap substrate.

We claim:

1. A leather or leather composite watch strap having an outer exposed surface comprising an assembly of a plurality of longitudinally adjoining individual segments where each segment has a first finished upper portion and a contiguous second portion that is overlapped by an adjacent segment, each segment comprised of a neck portion, and each segment being provided with first and second transverse openings and a neck portion of two other segments pass through each of the first and second openings and said neck portions are folded to lie in overlapping alignment beneath the segments, the overlapping segments being adhesively bonded to each other and to a strap substrate.

2. The strap of claim 1 where the upper surfaces of the assembled segments are tooled to provide a uniformly stepped configuration on the finished strap.

3. The strap of claim 1 where the exposed surface of the neck portion of each segment is vertically displaced from the contiguous second portion of the segment.

4. The strap of claim 1 where the thickness of the second portion of the segment is greater than the thickness of the finished portion of the segment.

5. The strap of claim 1 where the maximum thickness of a segment is about one millimeter.

6. The strap of claim 1 where the longitudinal length of each of the plurality of segments comprising the strap is the same.

7. The strap of claim 1 which further comprises a lug end piece having an exposed finished portion which overlaps the neck portion of an adjacent segment.

8. The strap of claim 7 which further comprises a buckle end piece or a point end piece, which buckle end piece and point end piece is comprised of an exposed finished portion and a second portion that is overlapped by the neck of an adjacent segment.

9. The strap of claim 1 in which a layer of resilient padding material is bonded between the overlapping segments and the strap substrate.

10. The strap of claim 2 which further includes decorative stitching.

* * * * *